US006079990A

United States Patent [19]

Martucci et al.

[11] Patent Number: 6,079,990

[45] Date of Patent: Jun. 27, 2000

[54] TERMINAL-RECEIVING SOCKET FOR MOUNTING ON A CIRCUIT BOARD

[75] Inventors: Roberto Martucci, Montegrotto Terme Padova; Gianni Zuin, Mestrino-Padova, both of Italy

[73] Assignee: Molex Incorporated, Lisle, Ill.

[21] Appl. No.: 09/241,357

[22] Filed: Feb. 2, 1999

[51] Int. Cl.[7] ..... H01R 9/09

[52] U.S. Cl. ..... 439/81

[58] Field of Search ..... 439/78, 79, 80, 439/81, 83, 853, 857

[56] References Cited

U.S. PATENT DOCUMENTS

| | | | |
|---|---|---|---|
| 1,552,189 | 9/1925 | Austrian | 439/842 |
| 3,437,983 | 4/1969 | Gilissen | 439/858 |
| 4,714,441 | 12/1987 | Corman | 439/842 |
| 5,046,972 | 9/1991 | Pass | 439/751 |
| 5,131,853 | 7/1992 | Meyer | 439/82 |
| 5,445,532 | 8/1995 | Evans | 439/161 |
| 5,653,601 | 8/1997 | Matrucci et al. | 439/82 |
| 5,709,574 | 1/1998 | Bianca et al. | 439/83 |
| 5,735,697 | 4/1998 | Muzslay | 439/83 |
| 5,917,707 | 6/1999 | Khandros et al. | 439/83 |

*Primary Examiner*—Khiem Nguyen
*Assistant Examiner*—J. F. Duverne
*Attorney, Agent, or Firm*—Stephen Z. Weiss

[57] ABSTRACT

A terminal-receiving socket assembly (10) is mounted on the bottom of a printed circuit board (12). The socket assembly includes a housing (22) having a terminal-receiving passage (28) in registry with a hole (14) in the board. A conductive contact (32) is mounted on the housing (22) for connection to a circuit (16) on the board and includes a pair of opposing contact arms (36) on opposite sides of the terminal-receiving passage (28) and engageable with a terminal (20) inserted thereinto. The terminal is inserted from the top of the board into the passage (28) and causes the contact arms (36) to flex downwardly (B) and outwardly, allowing for easy insertion of the terminal. However, withdrawal of the terminal (20) causes the flexible contact arms (36) to bias toward each other against the terminal to increase the withdrawal forces of the terminal.

7 Claims, 3 Drawing Sheets

TERMINAL-RECEIVING SOCKET FOR MOUNTING ON A CIRCUIT BOARD

FIELD OF THE INVENTION

This invention generally relates to the art of electrical connectors and, particularly, to an electrical terminal-receiving socket assembly for mounting on a printed circuit board.

BACKGROUND OF THE INVENTION

There are a wide variety of electrical connectors or terminating components which are mountable on a printed circuit board for receiving a complementary connector or other electrical device to be connected to the circuit board. In some instances, the connection to the circuit board is fairly permanent. In other applications, it is desirable to be able to connect and disconnect an electrical component to and from the circuit board by means of an electrical connecting device.

For instance, socket-type connectors may be mounted to a printed circuit board for receiving the terminal pins of an electrical component. The socket typically includes at least one contact for engaging the terminal pin, with the contact connected, such as by soldering, to a circuit trace on the circuit board. Therefore, the contact of the socket interconnects the terminal pin of the electrical component to the circuit trace on the printed circuit board.

One of the problems in designing electrical connectors such as terminal-receiving sockets for mounting on printed circuit boards is to ensure that the mating electrical component is not easily disconnected from the socket. In other words, it is not desirable for the terminal pins of the electrical component to be easily withdrawn from the socket, particularly accidentally or unintentionally during use. Unfortunately, when designing such sockets to have adequate anti-withdrawal forces, the insertion forces of the terminal pins into the sockets often are correspondingly increased. High insertion forces can cause the terminal pins to buckle or bend or actually be broken. High insertion forces also cause undue stresses on the printed circuit board and its associated components. The present invention is directed to solving these problems by providing a very simple and efficient terminal-receiving socket of the character described, wherein the socket allows for low terminal insertion forces while providing high terminal withdrawal forces.

SUMMARY OF THE INVENTION

An object, therefore, of the invention is to provide a new and improved terminal-receiving socket assembly for mounting on a printed circuit board.

For purposes of providing a clear and concise understanding of the invention, the circuit board is considered to have a top surface, a bottom surface and a hole extending therethrough. A circuit is provided on the bottom surface of the board adjacent the hole. However, it must be understood that the use of such terms as "top", "bottom", "upward", "downward", and the like herein and in the claims hereof is not in any way intended to be limiting in nature, because the socket assembly of the invention is omni-directional in use.

With that understanding, the socket assembly herein includes a housing positionable at the bottom surface of the printed circuit board. The housing includes a terminal-receiving passage in registry with the hole in the board. A conductive contact is mounted on the housing for connection to the circuit on the bottom surface of the printed circuit board. The contact has a pair of opposing arms on opposite sides of the terminal-receiving passage in the housing. Each contact arm is generally U-shaped to define a top leg and a bottom leg joined by an outboard bowed portion. The top leg is fixed to the housing and the bottom leg is flexible with a distal end projecting inwardly to a position of engagement by the terminal.

With the above structural combination, a terminal inserted form the top surface of the printed circuit board into the hole in the board and into the passage in the housing will engage the distal ends of the flexible legs of the opposing contact arms. The inserted terminal causes the flexible legs to spread apart, bending about the bowed portions of the contacts arms, allowing for easy insertion of the terminal. However, withdrawal of the terminal causes the flexible legs to bias toward each other against the terminal to increase the withdrawal forces on the terminal.

As disclosed herein, the housing includes a boss projecting into the hole in the printed circuit board from the bottom surface of the board. The terminal-receiving passage extends through the boss. The boss has an outwardly flared mouth to guide the terminal into the passage. The conductive contact includes a mounting base surrounding the boss on the housing and from which the top legs of the opposing contact arms extend. The distal ends of the bottom legs are flared downwardly in the insertion direction of the terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
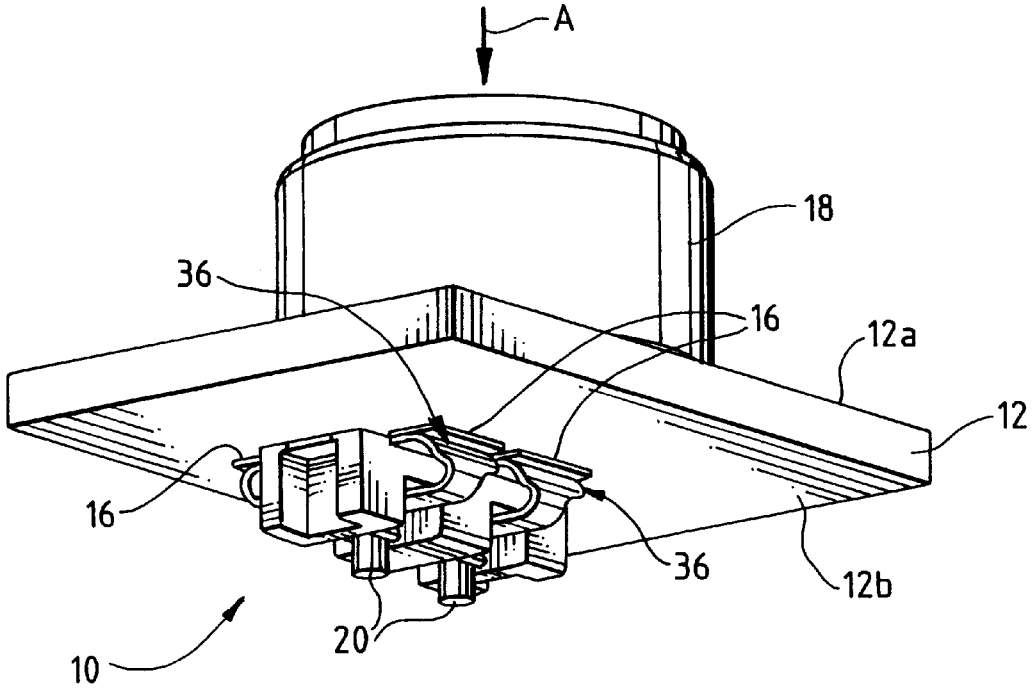
FIG. 1 is a perspective view showing the terminal-receiving socket assembly of the invention mounted at the bottom of a printed circuit board and with an electrical component having two terminal pins mounted on top of the circuit board.
Figure 2:
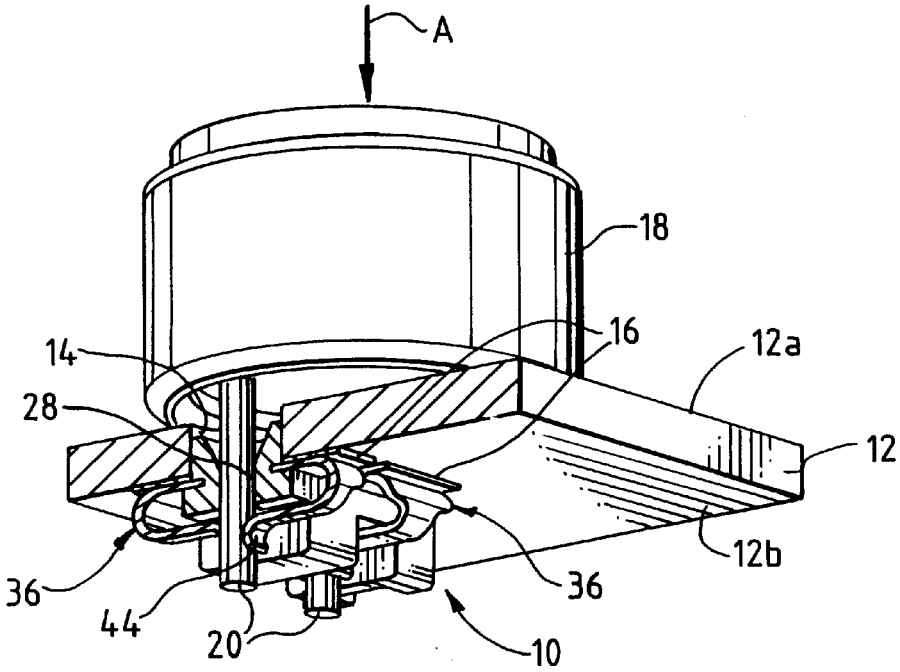
FIG. 2 is a view similar to that of FIG. 1, with a section through one of the terminal-receiving passages of the socket assembly.

Referring to the drawings in greater detail, and first to FIGS. 1 and 2, the invention is embodied in a terminal-receiving socket assembly, generally designated 10, for mounting on a printed circuit board 12. For purposes of illustration and for providing a clear and concise understanding of the invention, the printed circuit board is considered to have a top surface 12*a* and a bottom surface 12*b*. The circuit board has a pair of holes 14 extending therethrough between the surfaces. A circuit is provided on bottom surface 12*b* of the circuit board for connection to contacts of socket assembly 10. An entire circuit pattern is not shown on the circuit board, but pairs of circuit pads 16 are shown on the bottom surface of the board which is adequate for understanding the invention herein.

Still referring to FIGS. 1 and 2, an electrical component 18, such as a microphone, is mated from top surface 12*a* of the circuit board with socket assembly 10 at bottom surface 12*b* of the circuit board, in the direction of arrows "A". The electrical component includes a pair of terminal pins 20 which are insertable through holes 14 in the board into the socket assembly.

Figure 3:
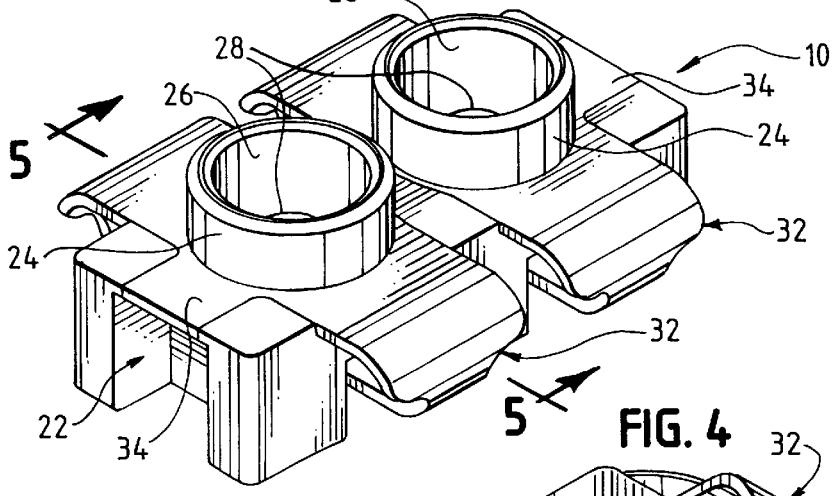
FIG. 3 is a top plan view of the socket assembly.
Figure 4:
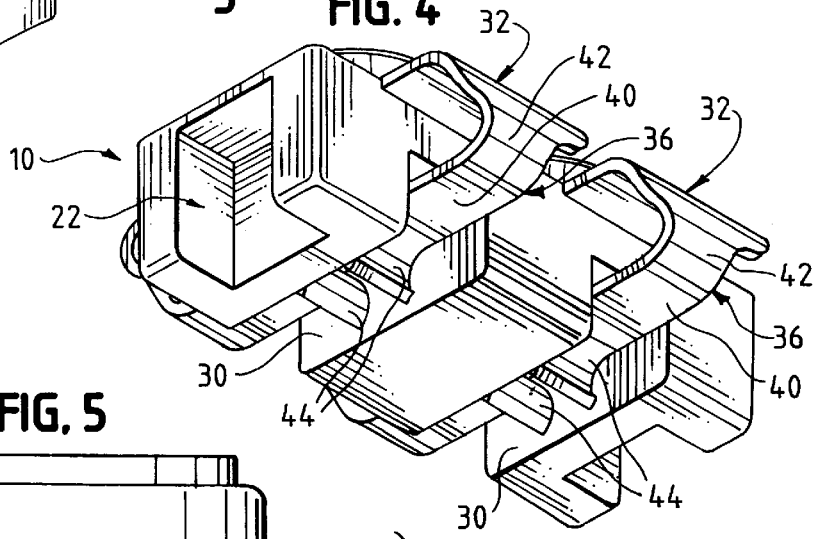
FIG. 4 is a bottom plan view of the socket assembly.

Referring to FIGS. 3 and 4 in conjunction with FIGS. 1 and 2, socket assembly 10 includes a one-piece housing, generally designated 22, which is unitarily molded of dielectric material such as plastic or the like. As best seen in FIG. 3, the housing has a pair of upstanding bosses 24 each defining an outwardly flared mouth 26 for guiding terminal pins 20 into a pair of terminal-receiving passages 28 extending through the housing. As best seen in FIG. 4, the bottom of the housing is provided with a pair of recessed areas 30. Each recessed area accommodates a pair of opposing contact arms of a pair of conductive contacts, as described below.

Specifically, a pair of conductive contacts, generally designated 32, are mounted on housing 22 for connection to circuit pads 16 on bottom surface 12*b* of circuit board 12. Each conductive contact includes a mounting base 34 overmolded by housing 22 and surrounding a respective one of the upstanding bosses 24. The mounting base is connected, as by soldering, to circuit pads 16 on opposite sides of boss 24 at the bottom of the circuit board.

Figure 5:
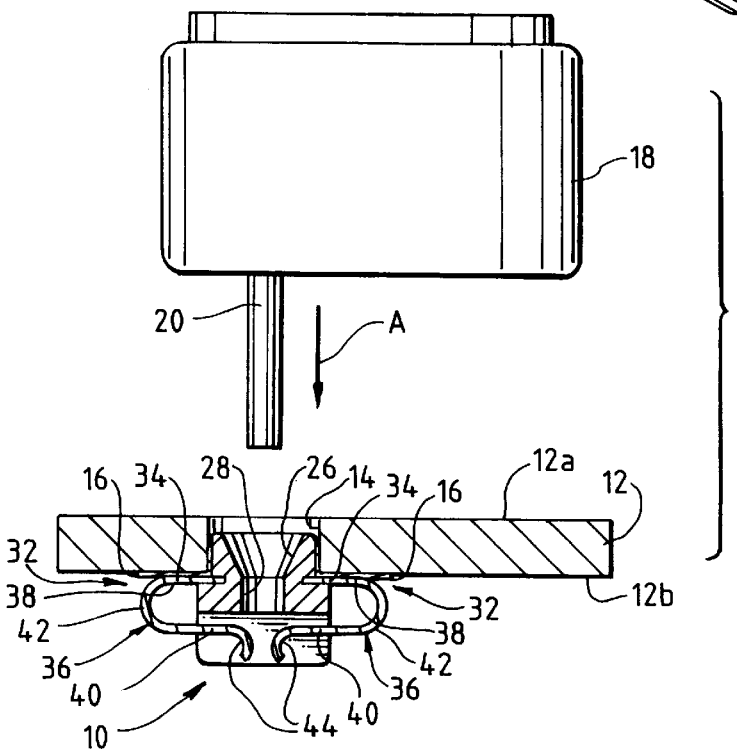
FIG. 5 is a vertical section taken generally along line 5—5 of FIG. 3, with the socket assembly inserted into a hole in the printed circuit board, in conjunction with a mating electrical component.

Referring to FIG. 5 in conjunction with FIGS. 3 and 4, each conductive contact 32 also includes a pair of opposing contact arms, generally designated 36, on opposite sides of the respective terminal-receiving passage 28. Each contact arm 36 is generally U-shaped to define a top leg 38 and a bottom leg 40 joined by an outboard bowed portion 42. Each bottom leg 40 includes a downwardly flared distal end 44 projecting inwardly to a position of engagement by the terminal. In the preferred embodiment distal ends 44 project into the terminal receiving passage 28.

Figure 6:
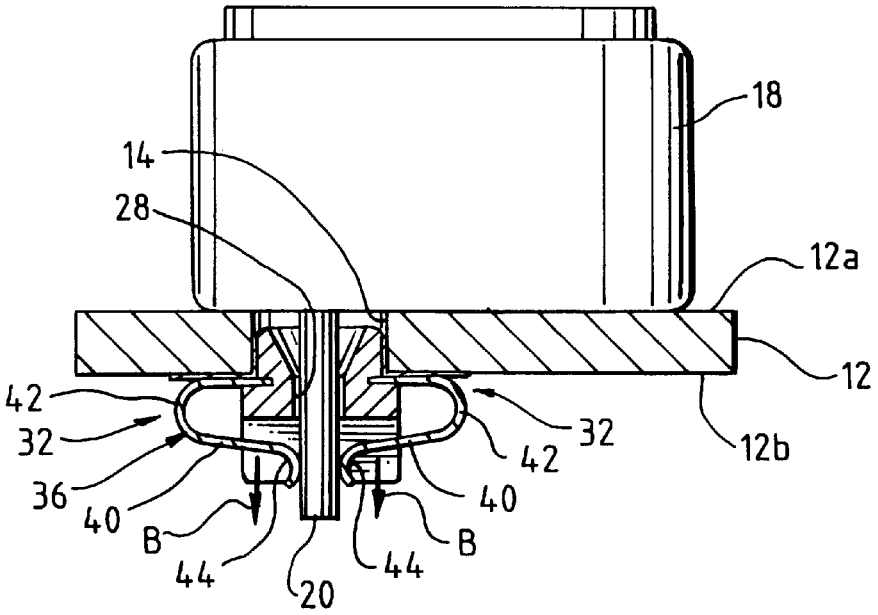
FIG. 6 is a view similar to that of FIG. 5, with the terminal pins of the electrical component inserted into the socket.

FIG. 5 shows electrical component 18 and terminal pins 20 about to be inserted into socket assembly 10 in the direction of arrow "A". FIG. 6 shows the electrical component seated on top surface 12*a* of circuit board 12, with the terminal pins 20 having been inserted from the top surface of the board through holes 14 in the board and into passages 28 in socket assembly 10. Upon insertion, each terminal pin 20 will engage downwardly flared distal ends 44 of bottom legs 40 of the opposing contact arms and cause the legs to move downwardly in the direction of arrows "B" (FIG. 6), spreading the legs and their distal ends apart. In essence, the bottom legs of the contact arms bend downwardly about bowed portions 42 of the contact arms. This flexing of the bottom legs of the contact arms allow for easy insertion of the terminal pins into the socket assembly. However, withdrawal of the terminal pins causes flexible legs 40 to bias upwardly and inwardly toward each other against opposite sides of the terminal pins to increase the withdrawal forces on the pins.

Figure 7:
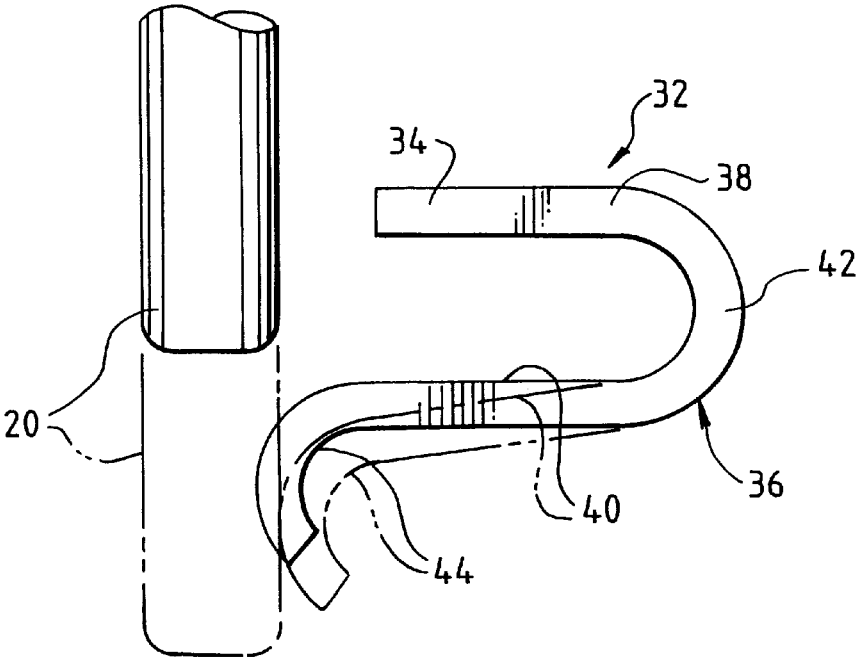
FIG. 7 is an isolated view of one of the terminal pins in conjunction with one of the contact arms to show the movement of the arm upon insertion of the pin.

FIG. 7 shows one of the terminal pins 20 and one of the contact arms 36 in full lines prior to insertion of the pin. The pin and bottom leg 40 of the contact arm are shown in dotted lines having been moved downwardly and outwardly in the direction of arrow "B" in response to insertion of the pin. It can be understood that the pin is inserted with very low insertion forces, just enough to cause bottom leg 40 to flex or bend about bowed portion 42. However, on withdrawal of the terminal pin, bottom leg 40 cannot freely move upwardly because of the interference with the terminal pin, and the opposing bottom legs of the contact arms, in essence, "bind" against opposite sides of the terminal pin to increase the withdrawal forces thereon.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A terminal-receiving socket assembly for mounting on a printed circuit board having a top surface, a bottom surface and a hole extending therethrough, and a circuit on the bottom surface of the board adjacent the hole, the socket comprising:

a housing positionable at the bottom surface of the printed circuit board and including a terminal-receiving passage in registry with the hole in the board; and a boss projecting into the hole in the printed circuit board from the bottom surface of the board, the terminal-receiving passage extending through the boss; and a conductive contact mounted on the housing for connection to the circuit on the bottom surface of the printed circuit board, the contact having a pair of opposing contact arms on opposite sides of the terminal-receiving passage in the housing, each contact arm being generally U-shaped to define a top leg and a bottom leg joined by an outward bowed portion, the top leg being fixed to the housing and the bottom leg being flexible with a distal end projecting inwardly to a position of engagement by the terminal, whereby a terminal inserted from the top surface of the printed circuit board into the hole in the board and into the passage in the housing will engage the distal ends of the flexible legs of the opposing contact arms causing the flexible legs to freely spread apart, bending about said bowed portions of the contact arms, allowing for easy insertion of the terminal, and withdrawal of the terminal causes the flexible legs to bias toward each other against the terminal to increase the withdrawal forces on the terminal.

2. A terminal-receiving socket assembly for mounting on a printed circuit board having a top surface, a bottom surface and a hole extending therethrough, and a circuit on the bottom surface of the board adjacent the hole, the socket comprising:

a housing positionable at the bottom surface of the printed circuit board and including a terminal-receiving passage in registry with the hole in the board, the housing including a boss projecting into the hole in the board from the bottom surface of the board, the terminal-receiving passage extending through the boss; and a conductive contact including a mounting base for connection to the circuit on the bottom surface of the printed circuit board, the contact having a pair of opposing contact arms projecting from opposite sides of the mounting base on opposite sides of the terminal-receiving passage in the housing, each contact arm being generally U-shaped to define a top leg and a bottom leg joined by an outward bowed portion, the top leg being fixed to the housing and the bottom leg being flexible with a distal end projecting inwardly to a position of engagement by the terminal, whereby a terminal inserted from the top surface of the printed circuit board into the hole in the board and into the passage in the housing will engage the distal ends of the flexible legs of the opposing contact arms causing the flexible legs to freely spread apart, bending about said bowed portions of the contact arms, allowing for easy insertion of the terminal, and withdrawal of the terminal causes the flexible legs to bias toward each other against the terminal to increase the withdrawal forces on the terminal.

3. The terminal-receiving socket of claim 2 wherein said boss includes an outwardly flared mouth to guide the terminal into the passage.

4. The terminal-receiving socket of claim 2 wherein the distal ends of said bottom legs are flared downwardly in the insertion direction of the terminal.

5. The terminal-receiving socket of claim 2 wherein the distal ends of said bottom legs are projecting into the terminal-receiving passage.

6. A terminal-receiving socket assembly for mounting on a printed circuit board having a top surface, a bottom surface and a hole extending therethrough, and a circuit on the bottom surface of the board adjacent the hole, the socket comprising:

a housing positionable at the bottom surface of the printed circuit board and including a terminal-receiving passage in registry with the hole in the board; and a boss projecting into the hole in the printed circuit board from the bottom surface of the board, the terminal-receiving passage extending through the boss; and a conductive contact mounted on the housing for connection to the circuit on the bottom surface of the printed circuit board, the contact having a pair of opposing flexible contact arms on opposite sides of the terminal-receiving passage in the housing, the opposing contact arms having contact portions projecting inwardly to a position of engagement by the terminal, whereby a terminal inserted from the top surface of the printed circuit board into the hole in the board and into the passage in the housing will engage the contact portions of the contact arms causing the flexible arms to freely spread apart allowing for easy insertion of the terminal, and withdrawal of the terminal causes the flexible arms to bias toward each other against the terminal to increase the withdrawal forces of the terminal.

7. The terminal-receiving socket of claim 6 wherein said boss includes an outwardly flared mouth to guide the terminal into the passage.

* * * * *